United States Patent [19]

Salomon

[11] 4,135,728

[45] Jan. 23, 1979

[54] DEVICES MOUNTED ON A SKI

[75] Inventor: Georges P. J. Salomon, Annecy, France

[73] Assignee: S.A. des Establissements Francois Salomon & Fils, Annecy, France

[21] Appl. No.: 719,449

[22] Filed: Sep. 1, 1976

[30] Foreign Application Priority Data

Sep. 3, 1975 [FR] France ..... 75 26964

[51] Int. Cl.[2] ..... A63C 7/10

[52] U.S. Cl. ..... 280/605

[58] Field of Search ..... 280/605, 604, 632, 631, 280/623, 627

[56] References Cited

U.S. PATENT DOCUMENTS

| | | | |
|---|---|---|---|
| 3,391,944 | 7/1968 | Shimizu | 280/632 |
| 3,481,615 | 12/1969 | Salomon | 280/626 |
| 3,643,927 | 2/1972 | Berlenbach | 280/632 |
| 3,930,659 | 1/1976 | Salomon | 280/605 |

FOREIGN PATENT DOCUMENTS

| | | | |
|---|---|---|---|
| 581980 | 3/1934 | Fed. Rep. of Germany | 280/605 |

*Primary Examiner*—Robert R. Song
*Assistant Examiner*—Milton L. Smith
*Attorney, Agent, or Firm*—Haseltine, Lake & Waters

[57] ABSTRACT

A safety ski binding or a ski brake is mounted on a ski and includes an operating lever pivotally mounted on the ski and actuated by the sole of the boot when the boot is fitted to the ski. The operating lever is provided at its free end with a pedal having substantially flat elongated opposite surfaces and an elongated non-circular cross-section movable by contact with the boot into a position where the elongated direction of the pedal is parallel to the lower surface of a boot mounted on said ski.

6 Claims, 7 Drawing Figures

5
14
9
2
3
12
13
7
4
10
1
6
8
11

5
3
2
4
9
1
8
11
10
13
12

FIG.7
FIG.5
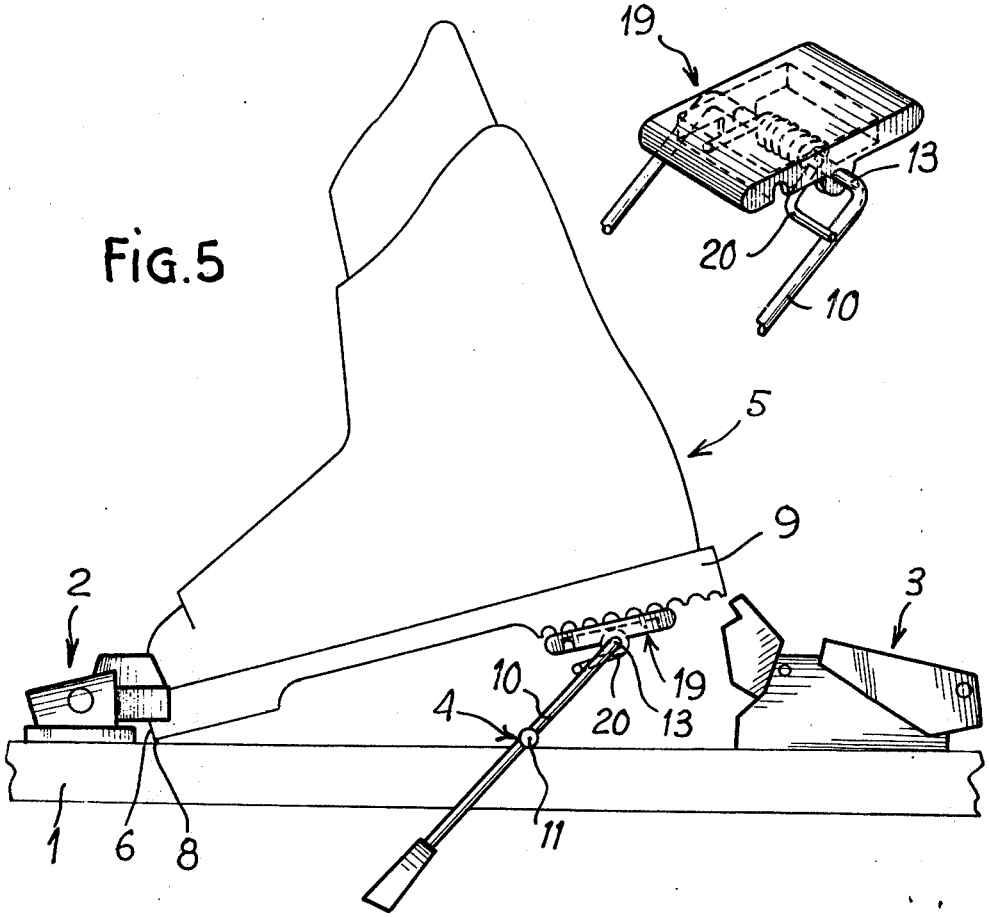
FIG.6
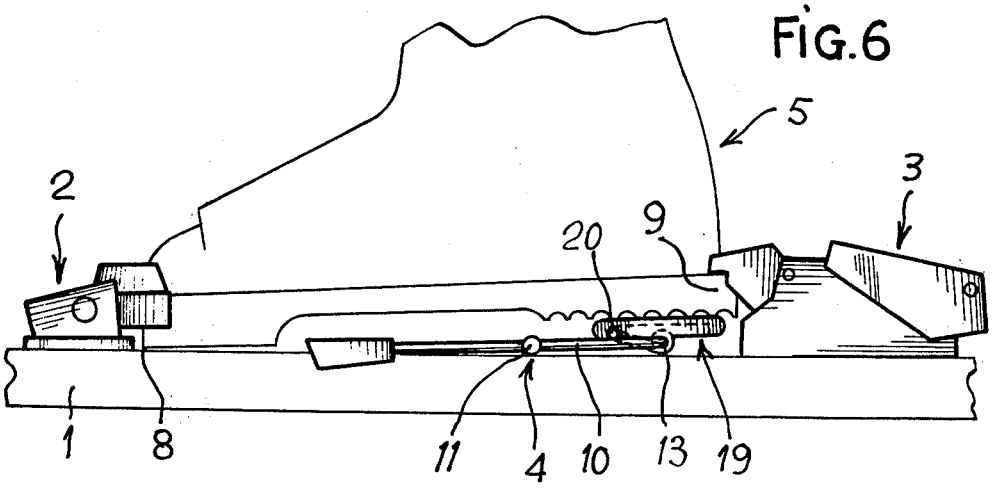

DEVICES MOUNTED ON A SKI

The present invention relates to improvements applied to devices mounted on a ski, such as safety bindings, brakes etc.

When the skier puts on his ski equipped with a safety binding, to which a ski brake is possibly added, he actuates a mechanism with his boot. This action is generally produced by the fact the the sole of the boot presses on a lever or pedal at the time of fitting the ski.

The ski boot, which is previously put in position by its point housed in a front abutment, thus pivots about this point or an adjacent point, whereas the controlled lever, belonging to the binding or the ski brake, pivots about another point. Due to this, the non coincidence of the centers of rotation or pivotal movement causes sliding of the lever under the sole. Since the latter is generally provided with a relief, in particular for preventing slipping when walking, there is a considerable risk of the end of the pivoting lever and the sole becoming engaged, for example with jamming.

To remedy this drawback, it is naturally possible to provide the end of the pivoting lever with a curvature such that this engagement is eliminated. However, an arrangement of this type has the disadvantage of taking up a considerable height under the sole, when the ski is fitted, owing to the fact that this sole rests on the curved part of the lever, which is in turn located at a certain distance from the upper side of the ski.

The object of the present invention is to remedy these drawbacks by means of a particularly simple arrangement of the pivoting lever.

To this end, this device mounted on a ski, such as a safety binding or ski brake comprising an operating lever actuated by the sole of the ski boot when the ski is fitted, is characterised in that at its end located below the sole of the boot, this lever comprises a pedal mounted to pivot on the lever about a pivot and of substantially flat straight elongated section.

The provision of a pivoting pedal at the end of the lever makes it possible to eliminate any engagement of the latter in the undulations on the sole and furthermore, owing to its section, this pedal can be retracted very easily under the sole of the boot, when the ski is fitted and does not cause exaggerated separation of the boot with respect to the upper surface of the ski, contrary to what would happen with a rotating pedal in the form of a circular roller.

Various embodiments of the present invention will be described hereafter, as non limiting examples, with reference to the accompanying drawings in which:

FIG. 5 is an elevational view of the entire device comprising a front abutment, a heel hold down device and ski brake, the lever of this ski brake being provided with a pivoted pedal biased by a spring, the heel hold down device being open under the boot and shown at the beginning of the operation of fitting the ski.

FIG. 6 is a view similar to that of FIG. 5, the heel hold down device being shown closed and the ski brake retracted in the horizontal position:

FIG. 7 is a partial perspective view, to an enlarged scale, of one embodiment of the pivoted pedal of the ski brake.

Figure 1:
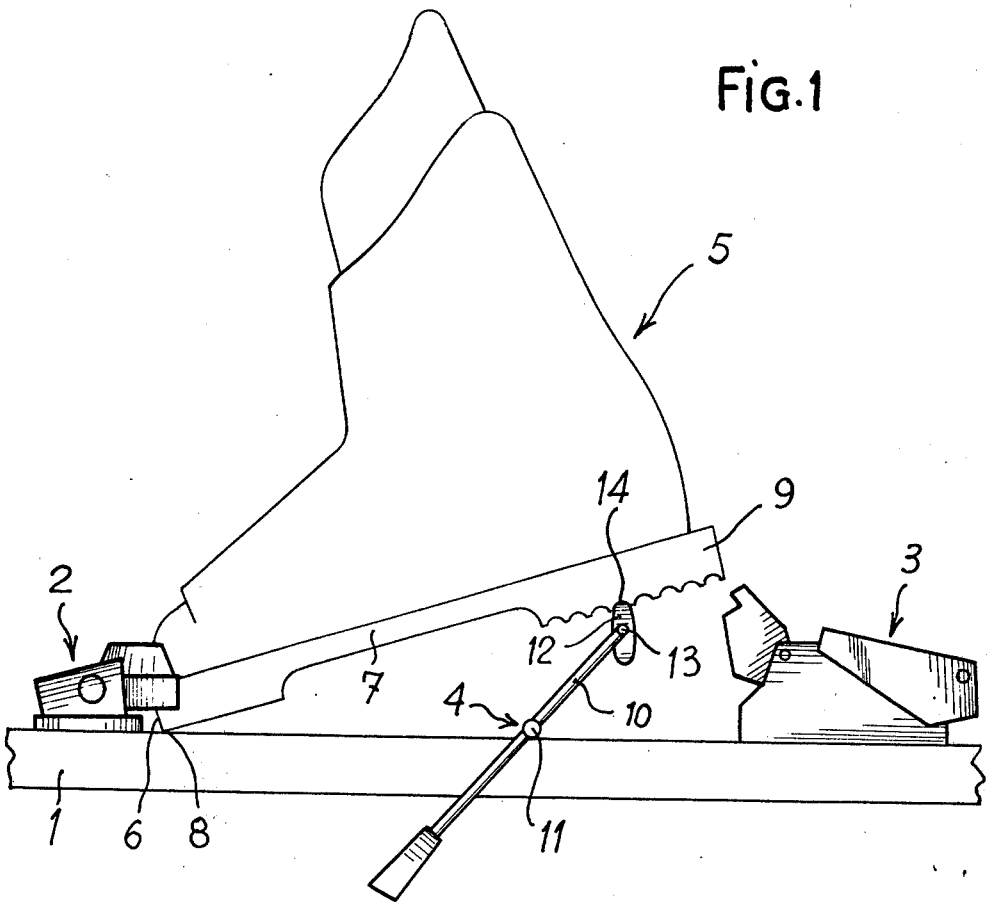
FIG. 1 is an elevational view of a device fixed to a ski, comprising a front abutment, a heel hold down device and a intermediate ski brake, the ski brake comprising a lever provided with a pivoted pedal, the boot being illustrated at the beginning of the operation for fitting the ski.
Figure 2:
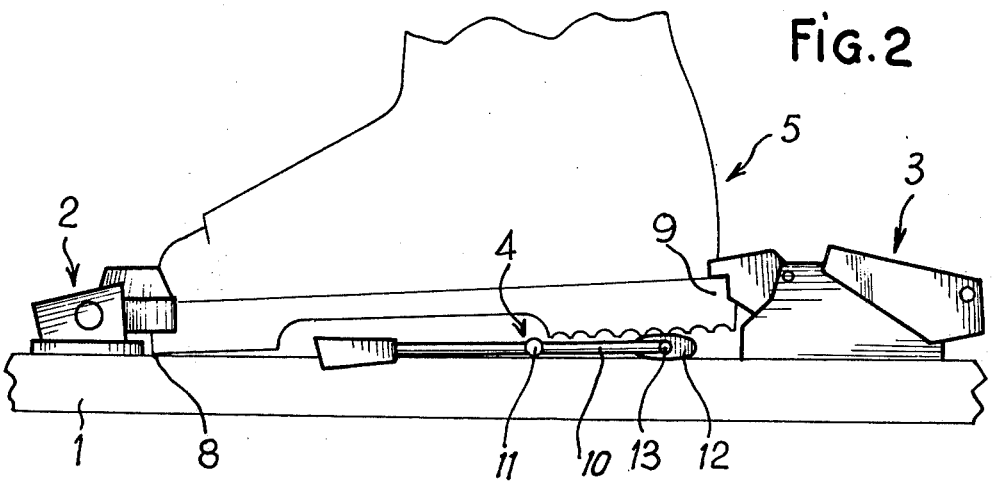
FIG. 2 is an elevational view similar to that of FIG. 1, the various devices being illustrated with the ski in the fitted position.

FIGS. 1 & 2 show a ski 1 supporting a front abutment 2, a heel hold down device 3 and a ski brake 4 on its upper side.

A ski boot 5 is also shown and is intended to engage and lock between the front abutment 2 and heel hold down device 3, thus retracting the ski brake 4 into the inoperative position as shown in FIG. 2.

When the skier fixes his ski, he engaged the point 6 of his sole 7 in the front abutment 2 and pivots the entire boot 5 about a transverse axis 8 located substantially at the place where the point 6 of the sole 7 touches the upper part of the ski.

As can be seen in FIGS. 1 and 2, the heel 9 of the sole 7 generally comprises, on its lower side, considerable undulations which prevent slipping during walking. When the ski is being fitted, this heel bears on the upper end of a lever 10 forming part of the ski brake 4 and which is pivoted about a transverse and horizontal pivot 11. This ski brake 4 is normally urged into the working position, in which its front end projects under the sole of the ski as shown in FIG. 1, by a spring which is not shown.

According to the invention, at its upper end, i.e. the end which is located under the heel 9 of the sole 7, the lever 10 of the ski brake 4 supports a pedal 12 which is pivoted on the lever 10 about a transverse pivot 13 located at its end and which may be constituted by the latter bent at 90° towards the inside of the ski.

The pedal 12 has a straight section of a substantially flat elongated non-circular shape, for example of oval shape.

Since this pedal 12 is loosely mounted on the pin 13, at the beginning of the fitting operation, it may be substantially parallel to the heel 9 of the sole 7 and in this case, its length is such that it cannot engage the undulations of the heel. It may also be substantially perpendicular to the heel 9, as shown in FIG. 1, and in this case there is a risk of engagement in the undulations of the heel. It will be seen from FIG. 1 that the pedal 12 is engaged in the bottom of a hollow 14 defined between two adjacent projections on the heel 9. Consequently, during fitting, the non coincidence of the axes of rotation 8 and 11 causes a deformation of the quadrilateral formed by the two fixed axes 8 and 11, the moveable transverse pin 13 and the hollow 14, a deformation such that the pedal 12 ceases to be perpendicular to the heel 9 of the sole and in turn assumes a position in which it is located substantially parallel to the heel 9. It is thus possible to reliably prevent any risk of inopportune engagement. It should be noted that the oval or elliptical shape is particularly advantageous. In fact, since contact with the sole occurs in the region of the small axis of the ellipse, the remainder of the curved profile is not in contact with the sole, which prevents any risk of engagement.

In the fitted position (FIG. 2), the pedal 12 occupies little height under the heel 9, owing to its elongated straight section and it in no way hinders the engagement of the boot 5 between the front abutment 2 and heel hold down device 3.

Figure 3:
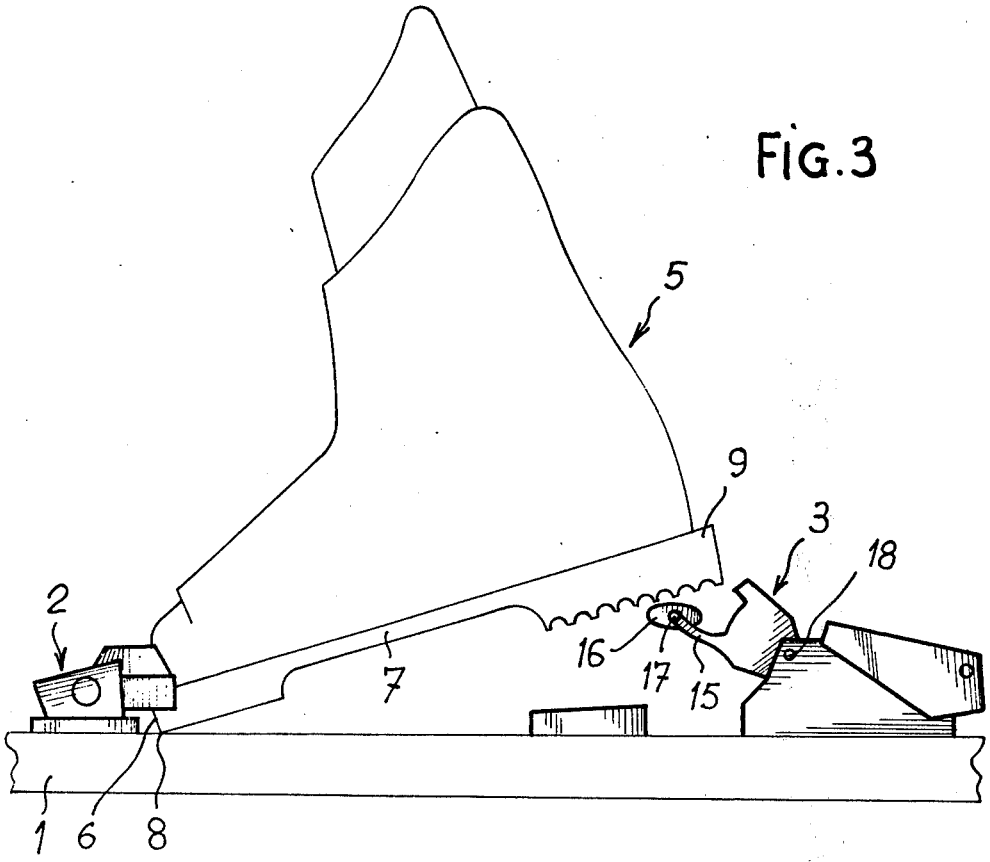
FIG. 3 is a diagrammatic elevational view of a front abutment and a heel hold down device, at the beginning of the operation of fitting the ski, the heel hold down device comprising an operating lever supporting a pivoted pedal.
Figure 4:
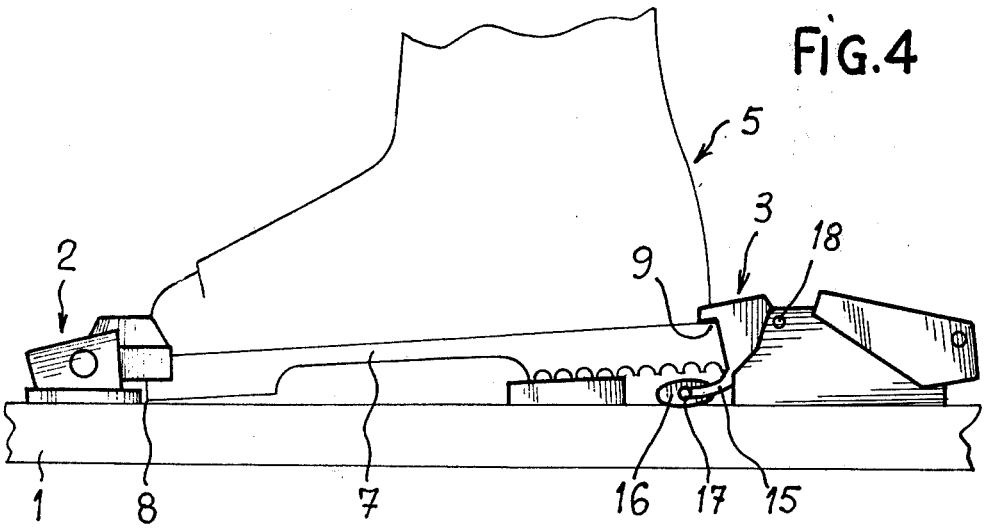
FIG. 4 is a diagrammatic elevational view similar to that of FIG. 3, the heel hold down device being shown in the closed position.

FIGS. 3 and 4 illustrate and application of the invention to the heel hold down device 3 which is provided with an operating lever 15 on which bears the heel 9 of the boot 5, during the operation of engaging the heel hold down device 3.

At its end, this operating lever 15 supports a pedal 16, of straight section of a substantially flat elongated non-circular shape and which is pivoted on the lever 15 about a transverse pin 17. The lever 15 pivots about a pin 18 and as in the embodiment afore described, non coincidence of the pivot axes 8 and 18 causes automatic rotation of the pedal 16 about its pivot 17, such that it is substantially located parallel to the lower surface of the heel 9, if it was not so initially. Hereto, the pedal 16 is retracted under the heel 9, when the heel hold down device 3 is engaged and it has a reduced height so as not to hinder this engagement.

In the embodiment illustrated in FIGS. 5 and 7, the ski brake 4, located between the front abutment 2 and the heel hold down device 3 supports a pedal 19 at its upper end, which pedal is constituted by a plate pivoted about the transverse pin 13 supported at the upper end of the pivoting lever 10. The small plate 19 constituting the pedal is biased by a spring 20 ensuring the automatic return of the pedal 19 into a favorable position below the heel 9, i.e. parallel to the lower surface of the latter. It is also possible to provide an abutment ensuring retention of the pedal in this position, or limiting the rotation of the pedal rearwards, in clockwise direction. The spring 20 must have sufficient force to maintain the pedal 19 in the favorable position. However, this force should be relatively low in order that it yields under the pressure of the sole. In fact, it is sufficient if the spring 20 exerts on the pedal 19, a force less than that produced by the spring of the mechanism to be armed. As a variation, the pedal could be obtained simply by bending the lever 10 with an angle which is sufficiently obtuse that it flattens out resiliently at the end of fitting the ski.

The invention is not limited to the single embodiment described and illustrated, but on the contrary includes all variations.

What is claimed is:

1. A ski brake apparatus mounted on a ski employing a lever assembly actuatable by a ski boot and having a pedal at its end which is pivotally mounted on said lever assembly through a pin, said pedal having a pair of substantially flat elongated opposite surfaces and having an elongated non-circular cross-section whereby said pedal forms a pair of lever arms, each of which is fulcrumed on said pin, lither of said pedal lever arms being actuatable in response to contact with said ski boot to urge said pedal into a position substantially parallel to a lower surface of said ski boot to enable a sole of said boot to slide along a flat upper surface of said pedal during pivotal movement of said pedal without interference by projections on said sole of said boot.

2. A ski brake apparatus according to claim 1, comprising an abutment for limiting the displacement of said pedal, said abutment being disposed on one side of said apparatus.

3. A ski brake apparatus according to claim 1 wherein: said pedal has an oval section.

4. A ski brake apparatus according to claim 1 wherein; said pedal is constituted by a flat plate.

5. A ski brake apparatus according to claim 1 wherein: the pivot axis of the pedal extends transversly of the ski.

6. A heel hold down device for a ski binding mounted on a ski, said device employing a lever assembly actuatable by a ski boot and having a pedal at its end which is pivotally mounted on said lever assembly through a pin, said pedal having a pair of substantially flat elongated opposite surfaces and having an elongated non-circular cross-section whereby said pedal forms a pair of lever arms, each of which is fulcrumed on said pin, either of said pedal lever arms being actuatable in response to contact with said ski boot to urge said pedal into a position substantially parallel to a lower surface of said boot to enable a sole of said boot to slide along a flat upper surface of said pedal during pivotal movement of said pedal without interference by projections on said sole of said ski boot.

* * * * *